US010477930B2

(12) United States Patent
Kuypers et al.

(10) Patent No.: US 10,477,930 B2
(45) Date of Patent: Nov. 19, 2019

(54) PORTABLE SUN SHADE

(71) Applicants: William Kuypers, St. Petersburg, FL (US); Brian Patrick Kuypers, Jupiter, FL (US)

(72) Inventors: William Kuypers, St. Petersburg, FL (US); Brian Patrick Kuypers, Jupiter, FL (US)

( * ) Notice: Subject to any disclaimer, the term of this patent is extended or adjusted under 35 U.S.C. 154(b) by 0 days.

(21) Appl. No.: 16/015,040

(22) Filed: Jun. 21, 2018

(65) Prior Publication Data

US 2019/0116947 A1 Apr. 25, 2019

Related U.S. Application Data

(63) Continuation-in-part of application No. 15/791,356, filed on Oct. 23, 2017, now abandoned.

(51) Int. Cl.

| | |
|---|---|
| ***A45B 23/00*** | (2006.01) |
| ***E04H 15/58*** | (2006.01) |
| ***A45B 17/00*** | (2006.01) |
| ***A45B 25/02*** | (2006.01) |
| *E04H 15/44* | (2006.01) |

(52) U.S. Cl.

CPC ..... *A45B 23/00* (2013.01); *A45B 17/00* (2013.01); *A45B 25/02* (2013.01); *A45B 2023/0006* (2013.01); *A45B 2023/0093* (2013.01); *E04H 15/44* (2013.01); *E04H 15/58* (2013.01)

(58) Field of Classification Search

CPC ..... E04H 15/58; E04H 15/36; E04H 15/04; E04H 15/52; E04H 15/005; E04H 16/62; E04H 15/62; A45B 2023/0093; A45B 23/00; A45B 2023/0006; A45B 2023/0012

See application file for complete search history.

(56) References Cited

U.S. PATENT DOCUMENTS

| | | | | |
|---|---|---|---|---|
| 1,593,431 | A * | 7/1926 | Buie | E04H 15/48 135/117 |
| 1,820,002 | A * | 8/1931 | Forrester | E04H 15/44 135/140 |
| 2,002,296 | A * | 5/1935 | Joseph | A45B 17/00 135/155 |
| 2,817,548 | A * | 12/1957 | Wolfgang | A45B 23/00 403/104 |
| 2,845,078 | A * | 7/1958 | Singleton | E04H 6/025 135/118 |
| 4,285,355 | A * | 8/1981 | Lundblade | E04H 15/42 135/147 |
| 9,051,756 | B1 * | 6/2015 | Jenkins | E04H 15/003 |
| 9,675,146 | B1 * | 6/2017 | Howell | F16M 11/28 |
| 2004/0129184 | A1 * | 7/2004 | Kraker | A45B 25/00 108/50.12 |
| 2007/0215193 | A1 * | 9/2007 | Flores | E04H 15/003 135/157 |
| 2013/0206954 | A1 * | 8/2013 | Wells | E04H 12/2246 248/523 |

FOREIGN PATENT DOCUMENTS

| | | | | |
|---|---|---|---|---|
| CA | 2094109 | A1 * | 10/1994 | A47C 7/66 |

* cited by examiner

*Primary Examiner* — Noah Chandler Hawk

(57) ABSTRACT

A lightweight, easily portable, collapsible, and easy to assemble personal-use sunshade is designed for use at beaches or other expanses of loose or non-compacted sand, compacted soil or solid surfaces. The sunshade assembly includes a frame assembly and a shade assembly pivotably coupled to it, with pivot locking means so that the shade can be positioned at any effective angle.

16 Claims, 6 Drawing Sheets

PORTABLE SUN SHADE

CROSS-REFERENCE TO RELATED APPLICATION

This utility patent application is a continuation-in-part of pending U.S. utility patent application Ser. No. 15/791,356, "Portable Sun Shade," filed Oct. 23, 2017, and claims all available benefits of priority to said application. The entire content of U.S. utility patent application Ser. No. 15/791,356, "Portable Sun Shade," filed Oct. 23, 2017, is hereby incorporated into this application specification by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to lightweight, portable, collapsible, and easy to assemble, personal-use sunshades used at beaches or other expanses of loose, non-compacted sand, compacted soil or solid, impenetrable surfaces such as concrete.

BACKGROUND

People all over the world have enjoyed relaxing at ocean and lakeside beaches and sandy river strands, probably since before the dawn of recorded history. The parent application Ser. No. 15/791,356, "Portable Sun Shade" defines terms such as beaches, uncompacted soils, and other natural or artificial surfaces where people like to relax in the sun, and those details and definitions will not be repeated here as to the extent that they have already been incorporated in this specification document by reference.

Although reclining upon naturally heated sands or artificial surfaces such as patios and poolside recreation areas can be extremely pleasant, the exposure to sunlight can also be much more severe than in other environments, which has created a market and an industry for producing portable sun shades.

Lightweight portable shades can act as sails and can develop large forces due to wind loading. Less thoughtfully designed products can be blown away in whole or in part, leaving the user the chore of a downwind trek to retrieve the scattered articles. It would be advantageous for a portable sunshade to include means of support capable of resisting wind gusts while adaptable for use not only in loose, uncompacted soils, but also on hard, flat surfaces and also in pools.

People also enjoy floating in a pool on a raft, or in a floating lounge chair, or by means of their body's own positive buoyancy, and often like to have a sun shade nearby while floating. A shade deployed in open water can be displaced by natural wave action, tidal flows, and wakes propagating from boats and vessels.

Shades designed for use in pools must address additional challenges. They must rest on the bottom of the pool without damaging the pool liner material, which is often only a thin vinyl membrane which can be easily pierced by sharp or abrasive objects. They must resist displacement or tipping over not only by wind gusts but also from wave action generated by other swimmers. Also, unlike when walking, running or clambering over ground, many pool users are less aware of their own motion and inertia in water. Combined with other pool users who may be floating adrift while asleep or nearly so, the risk of a pool users colliding with a sunshade deployed in a swimming pool is much higher than a shade deployed on a beach.

The market currently lacks a reasonably affordable solution for a portable, personal-use sunshade which combines all the benefits of: being easy to carry, set up, and take down, being easy to understand how its components are supposed to be assembled or adjusted, allowing a user to position the shade and also easily adjust or re-position the shade as the sun moves in the sky over time, being capable of supporting one or more shade membranes of effective sizes, able to resist wind forces applied to the one or more shades, able to stand on a hard surface without digging or anchoring means, and able to be used in a pool, that is, able to stand in moving or wavy water without tipping drifting away, and unlikely to damage a pool liner when set up in a swimming pool.

BRIEF SUMMARY OF THE INVENTION

The invention is a lightweight portable sunshade that is both easy to assemble and easy to collapse into a compact volume for convenient carrying to or from a beach. The invention has a frame assembly and at least one shade assembly which can be affixed to the frame assembly in any of a plurality of horizontal, vertical, or other orientations with respect to the angle of sunlight, and it is therefore appreciated that a primary objective of the invention is to interpose a shading membrane between the sun and an object, a person, or a desired portion of natural ground or on an artificial surface.

Another objective is that a shade assembly can be positioned onto a support frame to orient a shade membrane with respect to an angle of sunshine to create an area shaded from the sun. Then, as time passes and the sun moves, the shade can be easily repositioned at a new angle or elsewhere on the support frame to keep the same area shaded.

Another objective of the invention is to provide means for securing a support frame assembly (for the shade) to the ground and especially a means for feet of the support frame assembly to grip into sandy or non-compacted soil. A corollary objective of the invention is to provide means for stabilizing such a support frame assembly when set up on a harder, impenetrable surface so that the entire assembly can withstand winds while remaining in place. Another corollary objective of the invention is to also afford means of stabilizing the support frame assembly even while is set up in a swimming pool or immersed in moving or wavy water.

Another objective of the invention is that the components of the frame assembly and the shade assembly can be readily assembled, and disassembled, and that the disassembled components present features which lead a user to imagine and execute a correct assembly sequence without needing to consult an assembly instruction sheet.

A further objective of the invention is that the light-weight disassembled components could be gathered or arranged into a compact mass which can be conveniently placed into a kit bag for transport and storage. A corollary objective of the invention is to provide a convenient, easy to carry, and attractive container for the components of the invention.

Various devices are currently available which attempt to address these challenges, although they may at best meet only one or two aspects of the totality of the requirements.

BRIEF DESCRIPTION OF THE DRAWINGS

A further understanding of the nature and advantages of particular embodiments may be realized by reference to the remaining portions of the specification and the drawings. Similar reference numerals are used to refer to similar components.

DETAILED DESCRIPTION OF CERTAIN EMBODIMENTS

Figure 1:
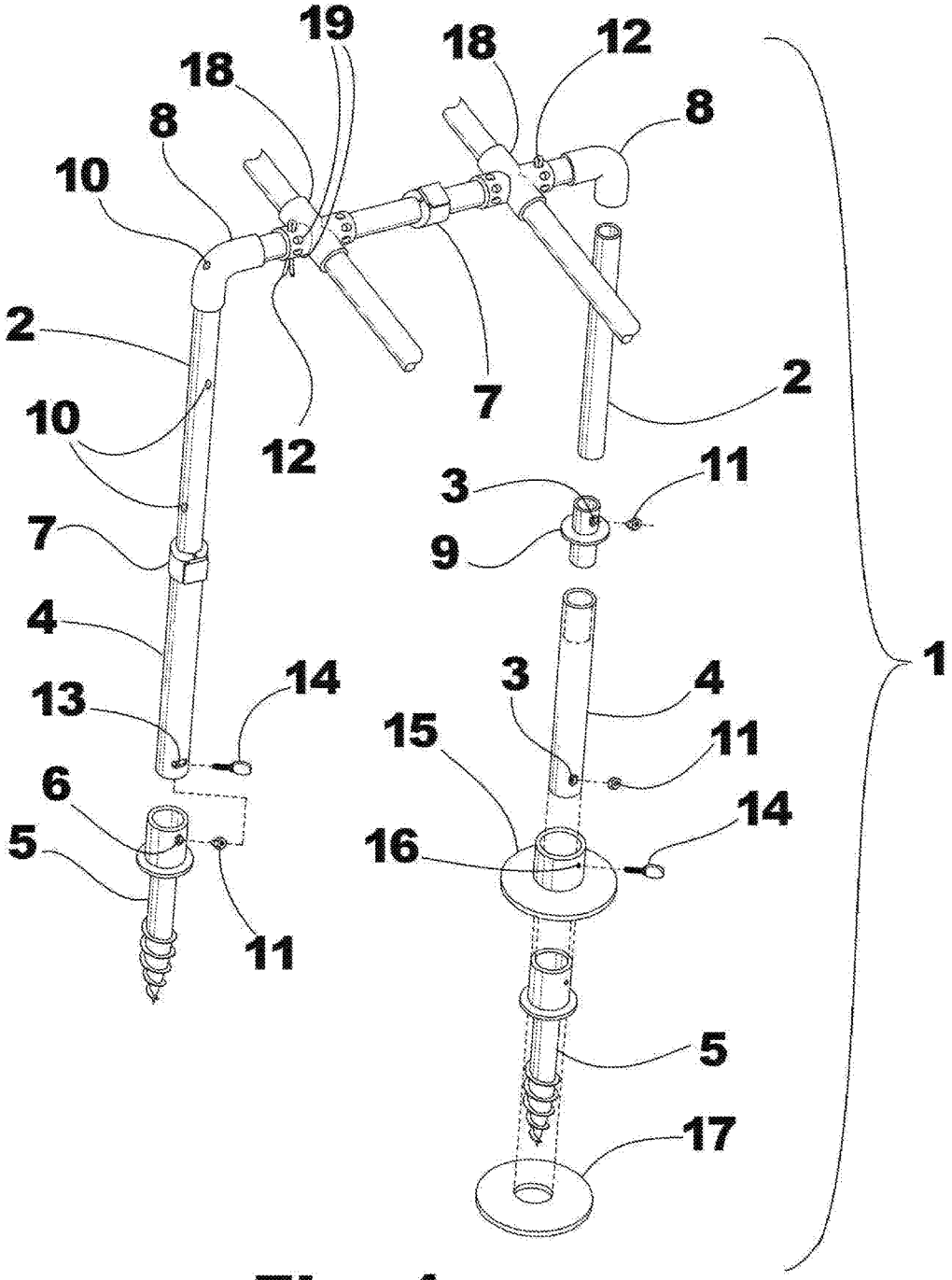
FIG. 1 shows the components of a typical frame assembly in accordance with the invention.
Figure 2:
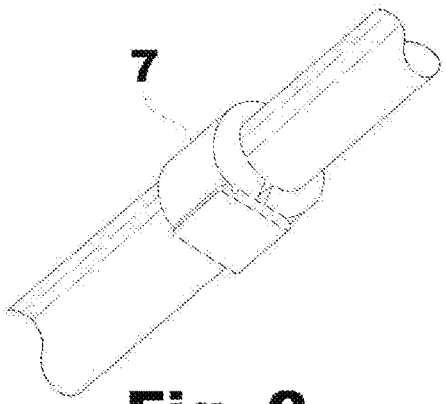
FIG. 2 shows a flip lock clamped onto two telescoping tubes.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In this specification, the term "means for . . . " as used herein including the claims, is to be interpreted according to 35 USC 112 paragraph 6.

This description of the invention uses cylindrical coordinate terms to define (a) axial direction, which is also longitudinal direction for a bar, tube, pipe or a beam, (b) radial direction which is perpendicular and directly toward or away from an axis, and (c) azimuth direction, which is orthogonal to an axis and a radius and tangent to that radius. Also in this specification, "twisting" in the context of a "twist-lock" refers to relative rotation of one object with respect to another object rotatably coupled to it. Unless explicitly stated, "twisting" in this specification does NOT refer to torsional deformation of a material or object.

The invention is a lightweight, easily portable, collapsible, and easy to assemble personal-use sunshade designed for use at beaches or other expanses of loose or non-compacted sand, compacted soils or solid surfaces. The invention can also be set up in a swimming pool or in relatively still open water. The invention comprises one or more sunshade assemblies which include shade beams and fabric spanning these shade beams, and a frame to which a shade assembly can be pivotably coupled, and pivot locking means so that the shade can be positioned at any effective angle. A shade can also be affixed to other locations on the shade frame assembly. This application describes a more specific range of embodiments than the parent application, and all the word definitions recited in the parent are present and in force in this document by incorporation by reference as recited herein.

The sunshade has a frame which is an assembly that includes two extendable legs which are used to adjust the height of the shade support components and are also used to level the horizontal components of the frame. FIG. 1 shows the components of a typical frame assembly [1] in accordance with the invention. The shade assembly and its variations are shown and described elsewhere. The legs of the frame are adjustable length legs each having an upper leg beam [2] and a lower leg beam [4,] which are preferably round tubes in which one can nest inside the other. It is more probable that the upper beam will be sized to fit inside the lower beam, but the frame can be constructed this relationship reversed as well. Also the beams in the embodiments of the invention shown and described here are tubes and preferably PVC or CPVC or metal piping in commonly available standard sizes. The beams of the invention shall hereafter be referred to as "tubes" for clarity.

The length of the leg is adjusted by controlling how much of the length of the smaller tube resides inside the larger tube, and a coupling locks the smaller within the larger and established the length of the leg. One type of coupling is a flanged adapter [9] having an upper projection extending upward from the plane of the flange, and the lower tube has a lower projection extending downward. The lower tube is permanently attached to the lower flange, such as by cement glue or epoxy or the like. The upper tube can slide into the flange so that a portion of its length resides within the lower tube. The coupling also has a threaded insert or threaded aperture [3] and a threaded fastener such as a thumbscrew, machine screw, or a set screw [14] can pass so that it can be tightened to impinge on the surface of the upper tube and secure it or lock the upper tube against further travel. Item [14] will be referred to as a thumbscrew in this specification even though it can be one of many kinds of threaded or unthreaded fasteners.

Other couplings which include means of locking two nested, telescoping tubes include flip locks and twist locks. The left leg in FIG. 1 comprises an upper tube [2] and a lower tube [4] coupled by a flip lock [7.] as shown in FIG. [2.] The engineering details of a flip lock are beyond the scope of the invention, but generally the device includes a handle which is a lever operating an over-center cam or nose to impinge against or to constrict its diameter against one or both of the tubes to lock them together at a predetermined extension length. The handle of the over-center cam can operate by axial rotation on an axis parallel or perpendicular to the axis of the telescoping tubes.

A sand screw is also called a sand auger or a sand anchor, and it comprises a short tube with a tapered auger for screening into loose or uncompacted soil or sand. The legs of the invention can be configured to anchor into sand or to be supported vertically on a hard, impenetrable surface such as a patio or on a surface where it is desired not to penetrate or damage, such as the vinyl liner on the bottom of a swimming pool.

Returning to FIG. 1, the ground engagement components of the invention can be a sand screw [5] or a foot [15] or both. The sand screw has a tube section sized to engage with the lower tube [4] either by receiving the outer diameter of the lower tube within its inner diameter, or by receiving the inner diameter of the lower tube within its outer diameter. The tube section of the sand screw includes an aperture [6] which is fitted with a threaded insert [11.] Although aperture [6] may itself be threaded and the threaded insert omitted, it is preferred to include the threaded insert for durability. The lower tube may include a slot [13] near its lower end which can be lined up with the aperture [3] when installed onto the sand screw. When the aperture and slot are aligned, a thumbscrew [14] can be inserted into the threaded aperture [3] or the threaded insert [11] while also passing through the slot and thus coupling the lower tube to the sand screw. Otherwise the thumbscrew can apply pressure onto the lower tube when inserted. The leg assembly can afford convenient grasping surfaces to twist the leg tube while applying downward force, which can assist in screwing the sand screw into the ground.

A foot [15] having a foot membrane and an upwardly projecting tube section can be provided to set up the lower tube of a leg assembly for use on hard, impenetrable surfaces or for use in standing the shade in a swimming pool. The tube section of the foot can either by receive the outer diameter of the lower tube within its inner diameter; or can receive the inner diameter of the lower tube within its outer diameter. The tube section has an aperture [16] which can be aligned with a threaded aperture [3] in the lower end of a lower leg tube [4] so that a thumbscrew [14] can pass through both the aperture [16] in the foot and the threaded aperture [3] so as to couple the lower leg tube to the foot. Otherwise the thumbscrew can apply pressure onto the lower tube when inserted. For additional durability, the traded aperture [3] can be an aperture fitted with a threaded insert [11.]

For windier days, or for setting up in a pool or in open water where more wave action or currents are expected, one or more weight plates [17] can be added atop the flange of a sand screw or atop the foot membrane portion of a foot [15.] A foot membrane is usually a round foot pad with a diameter or rim substantially larger than its upwardly projecting tube section. The combination of sand screws and weight plates is known by the inventors to be able to withstand winds up to 40 mph. To put this into nautical, contexts, the invention when robustly anchored, can withstand winds 35 knots, up in to Force 8 on the Beaufort wind scale, and within the realm of conditions sufficient to issue "Small Craft Advisory" by the US National Weather Service. For less blustery conditions, the weight plate can be placed on the ground and the sand screw screwed into the sand through the hole in the weight plate, and the leg with its foot then secured to the sand screw. The foot, resting upon the firmness of the weight plate instead of upon looser soils, can derive additional stability from its large diameter contact area with the weight plate. The foot in contact with the weight plate, above or below it, is sufficient to increase the stability of the frame.

Once the two leg assemblies of the sunshade are set up, the user can then assemble the horizontal components of the shade support beam which extends and connects between the legs. An elbow [8] is fitted atop of each of the upper leg tubes [2.] The shade support may be a single tube or it can be an adjustable assembly of two or more telescoping tubes which can be extended to bring the shade membrane taut, and then fixed at that extension length, usually by means of a flip lock or a twist lock, or according to another variant within the scope of the invention, the shade support beam can be made of two telescoping beams with one beam of the adjustable assembly can have at least one trans-verse through aperture but preferably a plurality of such holes along its length. When the shade support beam, as an assembly, is adjusted to a desired length dimension this length is fixed by means by inserting a pin through a transverse through aperture. The pin passes through another hole or slot in another component of the shade support beam assembly and locks its length. A shade support beam or assembly component can also include a threaded insert so that other objects such as auxiliary shades can be affixed to the sunshade at these points. An auxiliary shade can be a membrane having an aperture so that a threaded fastener can pass through the aperture, engage with a threaded insert anywhere on any component of the sunshade, and be stabilized in place as the threaded fastener seats inside the threaded insert. Thus an elbow, a shade support beam, or an adjustable leg can have one or more threaded inserts for this purpose.

Other figures will describe these components and their variations within the scope of the invention in more detail. Note that once the shade support beam is extended to bring the shade membranes taut, it may distend the vertical leg assemblies beyond exactly vertical to form a trapezoid. This has no negative effect on the performance of the sunshade except as an aesthetic which the user may tolerate or may re-adjust the positions of the anchor points of the legs.

Lastly in FIG. 1, the shade is pivotable by means of pipe cross fittings [18] having a radial array of apertures [19] near the ends of two coaxial tubular protrusions of the four such which form the cross fitting. The tube sections received into the cross fittings also have at least one transverse aperture which can be aligned with the apertures in the cross fitting so that a rod or a pin [12] can be dropped into the aligned holes to lock the shade assembly at a preferred angle with respect to the sun. As the sun moves through the sky, the shade can be easily adjusted to a new angle by pulling out the pins, pivoting the shade so that a different set of holes in the cross fitting come into alignment with the holes in the shades support tubes, and then the pins are replaced so as to lock the shade assembly at its new desired angle.

Figure 3A:
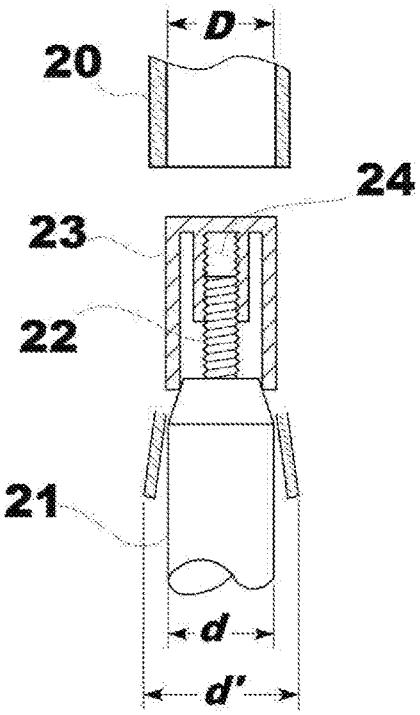
FIG. 3*a* shows a twist lock having an expanding cap (shown in cross-section) threadably coupled to a rod, for lockable insertion into a tube.

FIG. 3*a* shows a twist lock having an expanding cap [23] (shown in cross-section) threadably coupled to a rod [21] for lockable insertion into a tube [20.] The rod has a threaded stud [22] and the cap has an internally threaded bushing [24.] The external diameter [d] of the rod is slightly smaller than the internal diameter [D] of the tube, so that the rod can slide easily into and out of the tube in a telescoping action. When a desired overall length of tube [20] and rod [21] has been set, a twisting motion of the one with respect to the other causes the threaded cap to translate downward onto the rod so that its lower rim expands to a larger diameter [d'] sufficient to press-fit against the inside surface of the tube. The press-fit creates enough static friction to lock the tube and rod into a desired overall telescoped length. An alternative is to insert a pin through bored holes that align between the telescoping members.

Figure 3B:
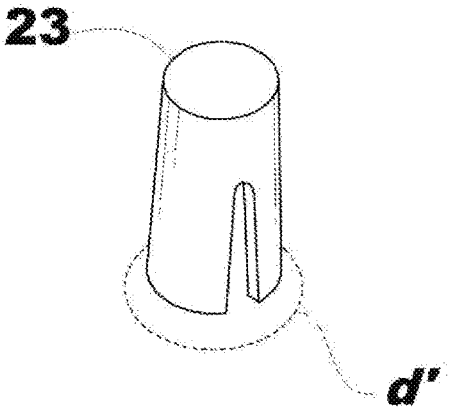
FIG. 3*b* shows an oblique, external view of a split-cup version of the expanding cap shown in FIG. 3*a*.
Figure 3C:
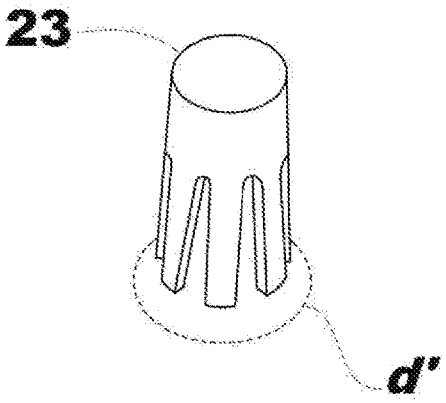
FIG. 3*c* shows an oblique, external view of an alternate embodiment of the expanding cap shown in FIG. 3*a*.

FIG. 3*b* shows an oblique, external view of a split-cup version of the expanding cap [23] shown in FIG. 3*a*. As above, the threading interaction of the cap and the rod expand the two halves of the cup to a larger diameter [d'] sufficient to press-fit and lock against the inner surface of the tube. Another alternate embodiment of the expanding cap [23] is shown in FIG. 3*c* having a plurality of splines which expand to a larger diameter [d'] sufficient to press-fit and lock within the inside surface of the tube.

Figure 4A:
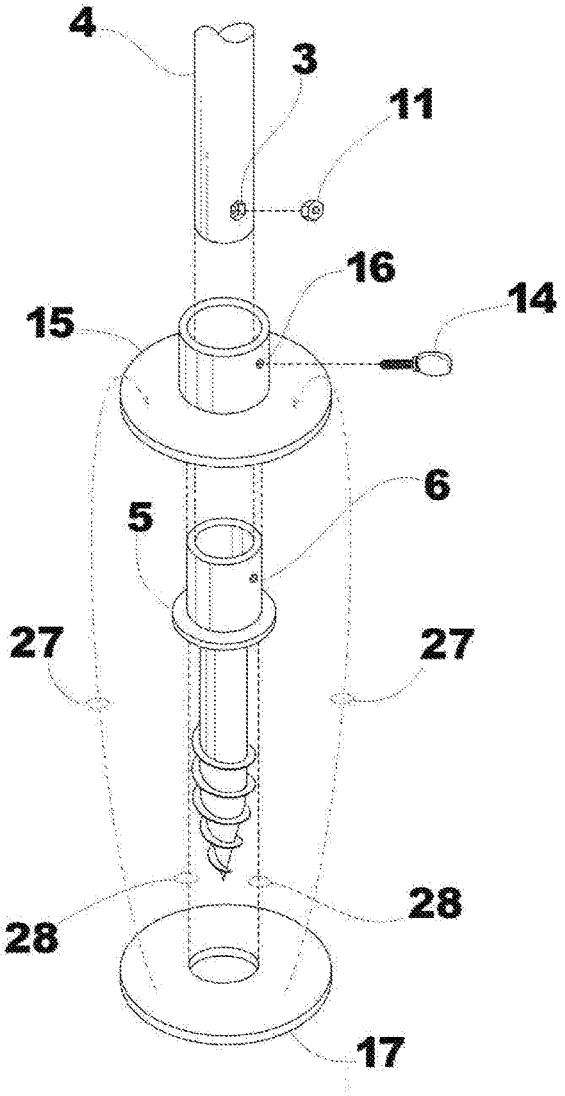
FIG. 4*a* shows an exploded view of an arrangement of a lower tube, a sand screw, a foot and a weight plate.

FIG. 4*a* shows an exploded view of an arrangement of a lower tube [4,] a sand screw [5,] a foot [15] and a weight plate [17] as they would be assembled for use in moving or wavy water or on windy days. In this embodiment shown, the lower end of a lower tube [4] has an aperture with a threaded insert [11] permanently installed therein. The foot has an upper projection with an aperture [16] in it as described above, and the leg tube is coupled to the foot by means of the threaded fastener [14.] The threaded fastener passes through the aperture in the leg tube so as to enter into the aperture [6] in the sand screw [5] as well. Thus the adjustable length leg is also coupled to the sand screw by means of a threaded fastener.

However, since the center hole in the weight plates [17] are sized to fit onto the upper projection of the foot, if it is desired to add one or more weight plates atop the foot for extra stability, these must be deposited onto the foot before the threaded fastener is installed. The phantom arrows [27] depict the weight plate in its position atop the flange or membrane portion of the foot, and the phantom lines [28] show that the size of the hole in the weight plate fits closely to the upper tube portion of the sand screw, but that the flange portion of the sand screw, being larger than this hole, can also retain the weight plates if it is desired to assemble them sandwiched between the flange of the sand screw and the foot. In either arrangement, the treaded fastener couples the adjustable length leg, the foot and the sand screw together as one.

Figure 4B:
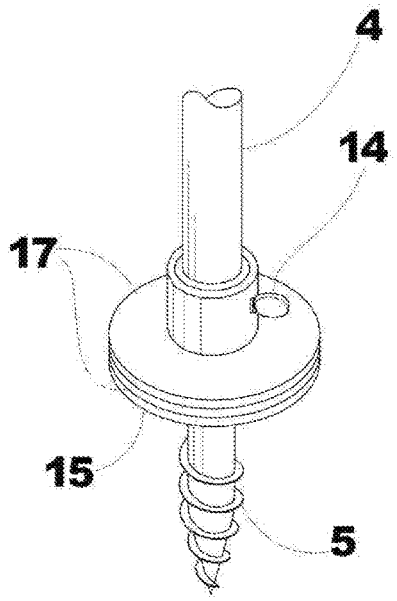
FIGS. 4*b* and 4*c* show the components of FIG. 4*a* assembled for use in moving or wavy water or on windier or gusty days.
Figure 4C:
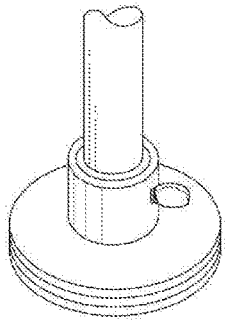

FIG. 4*b* shows the components of FIG. 4*a* assembled for use in moving or wavy water or on windy days, and to be screwed into sand or gravel or other loose soils. FIG. 4*c* shows these same components but with the sand screw omitted. Here it is shown that the extra weights [17] can be positioned atop the foot [15] for use on hard, impenetrable surfaces in gusty weather, or used in a swimming pool with no sharp edges or points that might damage a pool liner. Extra weights may be needed in swimming pools when other swimmers are creating larger waves by certain dives, games, or other boisterous activities.

Figure 5A:
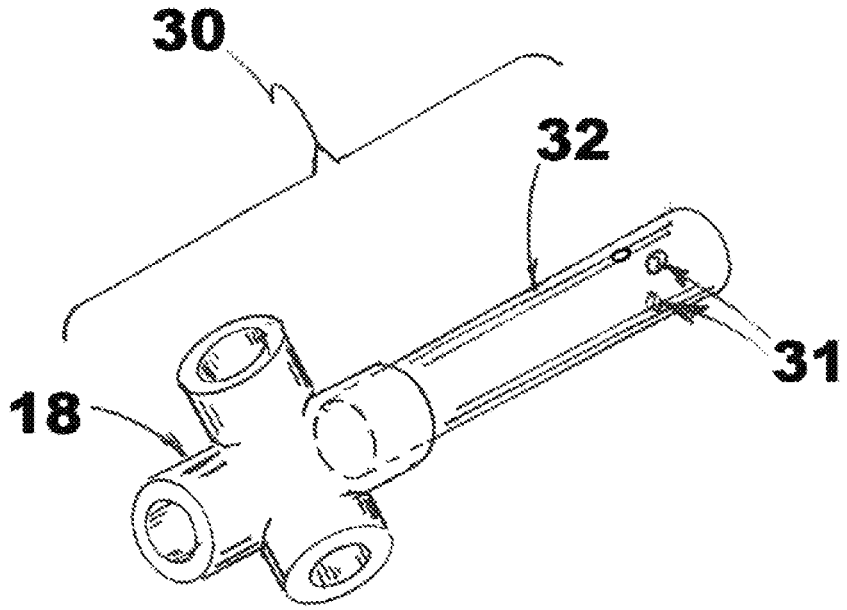
FIG. 5*a* shows a yoke used in an embodiment of a shade support frame in accordance with the invention.

FIG. 5*a* shows a component of special interest used as horizontal components of the shade support frame. This component will be called a "yoke" in this specification, because it links a first and second shade assembly attached to it or two portions of a large shade assembly so that they can be pivoted together as a unit. The yoke [30] consists of a cross fitting [18] into which a short length of tube [32] is permanently inserted. The tube has an array of through holes [31] at its end opposite from the cross fitting.

Figure 5B:
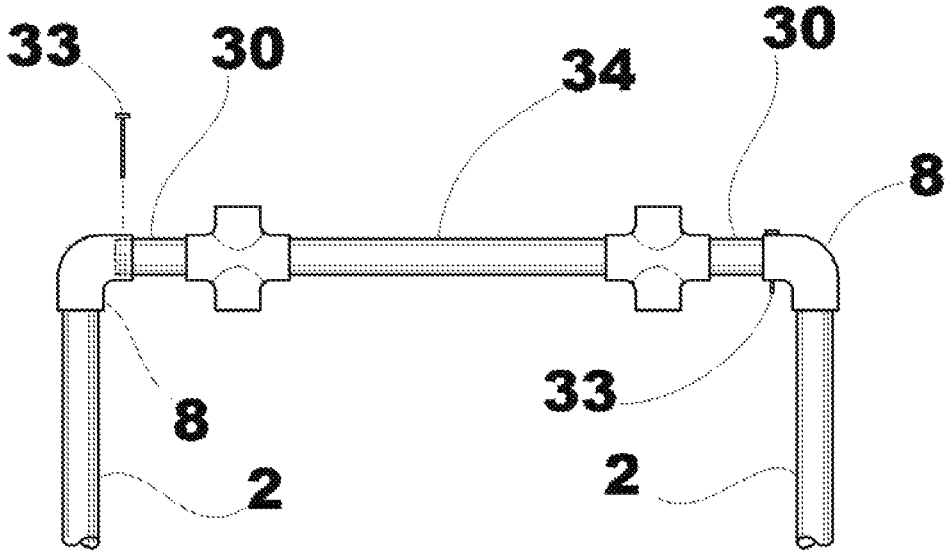
FIG. 5*b* shows an arrangement of horizontal components comprised within a shade support frame assembly in accordance with the invention.

FIG. 5*b* shows an arrangement of horizontal components comprised within a shade support frame assembly in accordance with the invention. The elbows [8] according to the embodiment shown include a vertical through hole. A yoke [30] is installed in each elbow and secured with a pin [33] which can also be a nail or any fastener having a long shank to pass through the elbow and also having a head to stop it from falling through. A single horizontal tube [34] is deposited between the two cross fittings of the two yokes and each of its ends is inserted into a cross fitting of a yoke. Referring back to FIG. 1, an alternative to a single tube [34] is to use two or more telescoping tubes and a flip lock so that the spacing between the axes of the cross fittings that are transverse to the axis of the tube [32] portion of the yoke can be adjusted.

Figure 6:
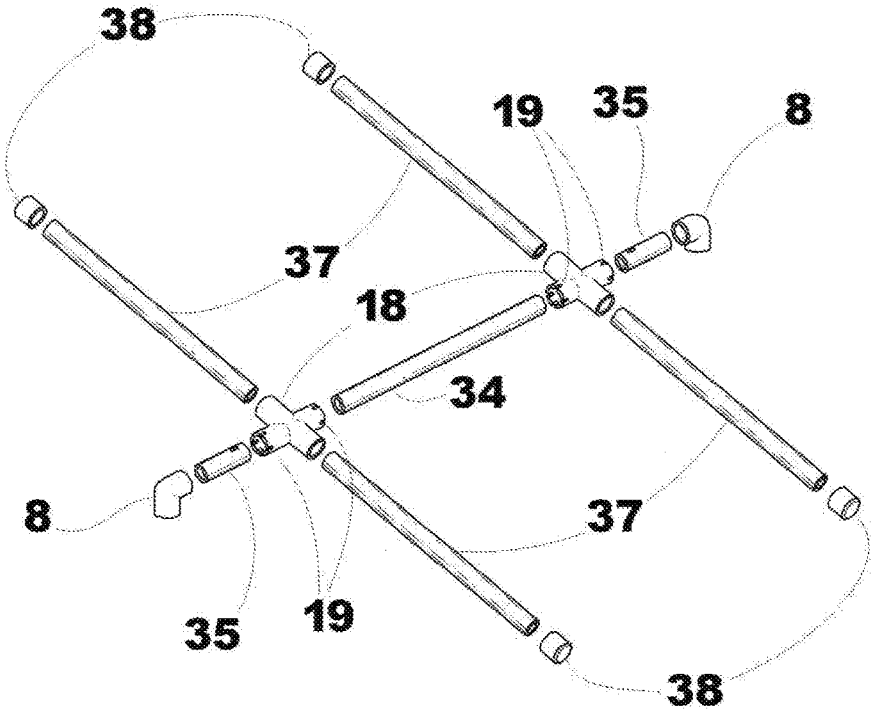
FIG. 6 shows an arrangement of horizontal components similar to those of the shade support frame assembly shown in FIG. 1, and also an arrangement of shade beams in accordance with the invention.

FIG. 6 shows an arrangement of horizontal components similar to those of the shade support frame assembly shown in FIG. 1, and also an arrangement of shade beams in accordance with the invention. In the embodiment shown in this figure, each elbow [8] has a short tube [35] with one end permanently inserted into it. The other end of each short tube has a transverse thru hole which is preferably parallel to the open end of the elbow. Each of two cross fittings [18] have an array of slots or holes [19] in the ends of two coaxial tubular protrusions of the assembly which forms each cross fitting. Because such a radial array of slots in a tubular projection of a cross fitting resembles a battlement of a castle tower, the end of such a tubular projection is called "castellated" and the slots are called "crenels." The two cross fittings are detachably inserted onto ends of a horizontal shade support tube [34.] Shade beams or shade tubes [37] are inserted into the remaining open apertures of the cross fittings. A typical shade assembly comprises a shade membrane attached to two shade beams which are each received into cross fittings. Although it is possible to use the invention with just one pair or shade beams installed into the cross fittings, the preferred mode would use two pairs of beams to increase the shade area offered by the invention.

Although the shade beams can be solid rods, tubes are preferable because these can be nested for storage and transport, and they are lighter to carry. Tube end caps [38] are offered to prevent foreign matter, insects, or other unwanted creatures from entering or nesting within the tubes.

Figure 7:
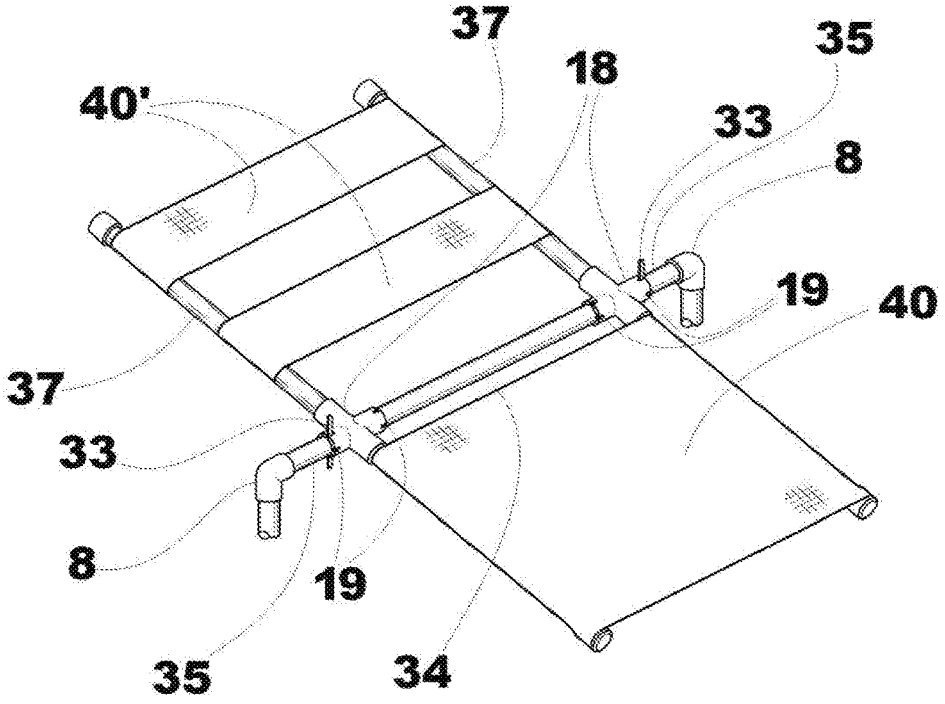
FIG. 7. shows shade membranes supported by their shade beams, which are attached to the shade support frame.

Proceeding to FIG. 7, two elbows [8] are installed onto the upper tubes [2 of FIG. 1] of the assembled and anchored legs of the invention. The short tubes [35,] cross fittings [18,] and the horizontal shade support tubes [34] are all assembled coaxially. The cross fittings can pivot about this axis and pivot the shade membranes [40, 40'] supported on their shade tubes [37.] The elbows connect the adjustable length legs to the shade support beam.

The angle of the shade support tubes is then fixed by installing pins, pegs, or other short rods or fasteners [33] through the transverse holes of the short tubes while they also pass through the crenels of castellated tubular projections, slots, or holes in the cross fittings. When it is desired to pivot the shade to a new angle because the sun and/or wind and/or rain has moved in the sky, the pins are removed and the shades can be pivoted. Then the pins are dropped back into their transverse holes and aligned holes or slots of the cross fittings, thereby re-locking the shade tubes at the new angle. The pins can also be inserted into transverse through apertures in the shade support beam, and in another embodiment an elbow can have a radial array of holes to pivot and lock the shade at a desired angle. An elbow can also be castellated as above so that locking of a shade at an angle is done by passing a pin through a transverse hole in a yoke or a shade beam and through one or two crenels of the castellated elbow.

A pair of shade tubes [37] can support one large shade membrane [40] or it can support a plurality of smaller shades [40'] or even a set of spaced apart strips to allow partial visibility through the gaps in the shade membranes spanning between two shade tubes. Shade tubes are also equivalently called shade beams. Gaps between shade membranes of a shade assembly can be used as in game of skill for throwing sports objects through these gaps, or to allow a user to look out of a gap between shades while remaining partially or mostly obscured.

Figure 8:
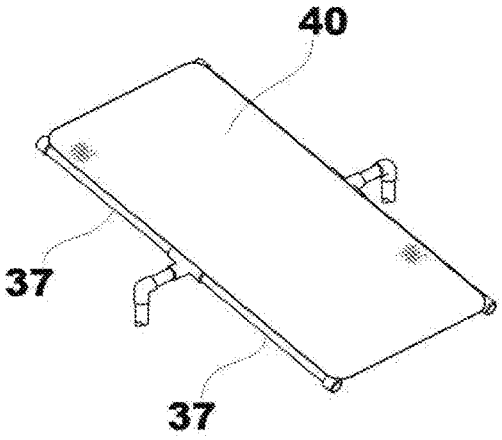
FIG. 8 shows a large shade membrane supported by four shade tubes in accordance with the invention.

FIG. 8 shows a large shade membrane [40] supported by four shade tubes [37] of which two are visible in this figure. Because the shade membrane is stretched taut, axial compression is established between the horizontal components of the shade support frame between the cross fittings. This fabric tension also compresses and holds the beams in their inserted positions in the cross fittings.

Figure 9A:
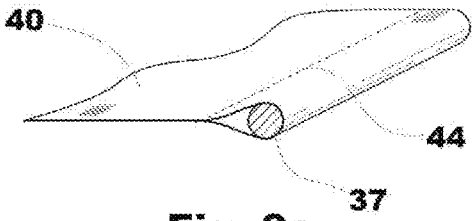
FIGS. 9*a*, 9*b*, 9*c*, and 9*d* show various methods for attaching a shade membrane to a shade tube.
Figure 9B:
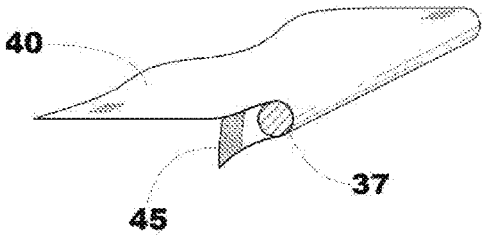
Figure 9C:
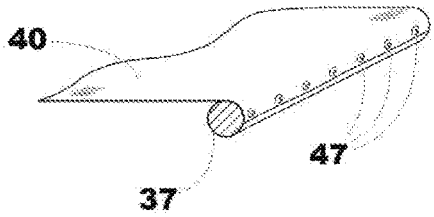

FIGS. 9*a*, 9*b*, and 9*c* show various methods for attaching a shade membrane to a shade tube. Shade tubes in these figures appear as solid rods, which is an alternative embodiment within the scope of the invention. FIG. 9*a* shows shade membrane fabric [40] sewn with a tube at its perimeter so that the shade tube [37] resides within it. The seam [44] may be made by sewing, stitching, basting, fusion by heating, or ultrasonic welding, or an adhesive. The seam may be intermittent or continuous.

FIG. 9*b* shows the shade membrane fabric [40] wrapped around the shade tube [37] and adhering to itself by means of a reclosable material [45] deposited at the fabric edge. Reclosable materials include Velcro®, Ziploc®, or similar strips comprising hook and loop fabrics, interdigitating ridges, and interlocking mushroomhead material, and other reclosable fabric strips. Where a reclosable material strip is formulated using two complementary intermateable strips, the hem or perimeter of the shade membrane will have a first strip attached [45] thereby, and a second complementary strip attached at an offset distance from the hem so that when the strips are intermated a lumen is formed within which the shade beam [37] can reside.

FIG. 9*c* shows a permanent attachment of shade membrane fabric [40] onto a shade tube [37] by means of a line of fasteners driven into the material of the tube or rod and transfixing the fabric at regular intervals. The fasteners can be screws, tacks, rivets, or nails or the like. According to an alternative embodiment, the hem of the fabric may be secured directly to the shade tube using an adhesive.

Figure 9D:
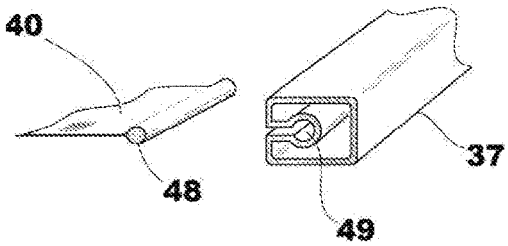

FIG. 9*d* shows a shade beam [37] which is an extrusion. The cross section of the extrusion has a lumen [49] and a channel open to the exterior of the cross section such that the channel width is less than the interior dimension of the lumen, such as an internal diameter. A shade membrane [37] includes a bead or welt [48] or piping filled with a cord which fits in the lumen of the extruded beam but is too large to escape through the channel, so the fabric can be held taut by the beam. A cord can also be incorporated into a fabric hem using a serger machine to stitch an overlock seam while trimming and finishing the edge.

While certain features and aspects have been described with respect to exemplary embodiments, one skilled in the art will recognize that numerous modifications are possible. Also, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems. Hence, while various embodiments are described with or without certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, and in summary, although many exemplary embodiments are described above, it will be appreciated that the invention is intended to cover all modifications and equivalents within the scope of the following claims.

What is claimed is:

1. A sunshade comprising:

a frame having a pair of adjustable length legs, a shade support beam extending between said legs, with said shade support beam comprising two cross fittings, two elbows connecting said shade support beam to said adjustable length legs, and to two shade beams which are each received into said cross fittings, wherein at least one of said adjustable length legs is coupled to a foot having a foot membrane, and a weight plate in contact with said foot.

2. The sunshade of claim 1, wherein a length of said shade support beam is adjustable.

3. The sunshade of claim 2, wherein said shade support beam further comprises a twist lock.

4. The sunshade of claim 2, wherein said shade support beam further comprises a flip lock.

5. The sunshade of claim 2, wherein a tube of said shade support beam further comprises a transverse through aperture, and a length dimension is fixed by means of a pin inserted through said shade support beam.

6. The sunshade of claim 1, wherein said shade support beam includes a threaded insert.

7. The sunshade of claim 1, wherein said adjustable length leg includes a twist lock.

8. The sunshade of claim 1, wherein said adjustable length leg includes a flip lock.

9. The sunshade of claim 1, wherein said adjustable length leg is coupled to said foot by means of a threaded fastener.

10. The sunshade of claim 1, wherein at least one adjustable length leg is coupled to a sand screw.

11. The sunshade of claim 10, wherein said adjustable length leg is coupled to said sand screw by means of a threaded fastener.

12. The sunshade of claim 1, wherein said adjustable length leg further comprises at least one threaded insert.

13. The sunshade of claim 1, wherein said elbow further comprises at least one threaded insert.

14. A sunshade comprising:

a pin, a frame having a pair of adjustable length legs, a shade support beam extending there between said legs, with said shade support beam comprising a transverse aperture and two cross fittings, wherein at least one of said cross fittings includes a tubular projection having a radial array of apertures, and two elbows connecting said shade support beam to said adjustable length legs, a first shade assembly comprising a shade membrane attached to two shade beams which are each received into said cross fittings, and a second shade assembly comprising a shade membrane attached to two shade beams which are received into said cross fittings, such that said pin can be received into both an aperture in said cross fitting and said transverse aperture in said shade support beam.

15. A sunshade comprising:

a pin, a frame having a pair of adjustable length legs, a shade support beam extending there between said legs, with said shade support beam comprising a transverse aperture and two cross fittings, wherein at least one of said cross fittings includes a tubular projection having a castellated end defining crenels, and two elbows connecting said shade support beam to said adjustable length legs, and a first shade assembly comprising a shade membrane attached to two shade beams which are each received into said cross fittings, and a second shade assembly comprising a shade membrane attached to two shade beams which are received into said cross fittings, such that said pin can be received into both a crenel in said cross fitting and said transverse aperture in said shade support beam.

16. A sunshade comprising:

a pin, a frame having a pair of adjustable length legs, a shade support beam extending there between said legs, with said shade support beam comprising a transverse aperture and two cross fittings, wherein at least one of said cross fittings includes a tubular projection having a castellated end defining crenels, and two elbows connecting said shade support beam to said adjustable length legs, and a shade assembly comprising a shade membrane attached to four shade beams which are each received into said cross fittings, such that said pin can be received into both a crenel in said cross fitting and said transverse aperture in said shade support beam.

* * * * *